US011528948B2

(12) United States Patent
Quiroga et al.

(10) Patent No.: US 11,528,948 B2
(45) **Date of Patent: *Dec. 20, 2022**

(54) MEDICAL GARMENT FOR CHEST DEVICES AND PROCEDURES

(71) Applicant: The Emilio Nares Foundation, San Diego, CA (US)

(72) Inventors: Luz A. Quiroga, Chula Vista, CA (US); Corina Elizabeth Quiroga Banzer, La Paz (BO)

(73) Assignee: The Emilio Nares Foundation, San Diego, CA (US)

( * ) Notice: Subject to any disclaimer, the term of this patent is extended or adjusted under 35 U.S.C. 154(b) by 189 days.

This patent is subject to a terminal disclaimer.

(21) Appl. No.: 16/996,803

(22) Filed: Aug. 18, 2020

(65) Prior Publication Data

US 2020/0375282 A1 Dec. 3, 2020

Related U.S. Application Data

(63) Continuation of application No. 15/885,605, filed on Jan. 31, 2018, now Pat. No. 10,779,590, which is a continuation of application No. 13/363,104, filed on Jan. 31, 2012, now Pat. No. 9,901,129.

(51) Int. Cl.
*A41D 13/12* (2006.01)

(52) U.S. Cl.
CPC ..... *A41D 13/129* (2013.01); *A41D 13/1245* (2013.01)

(58) Field of Classification Search
CPC .. A41D 13/1245; A41D 13/129; A41D 1/215; A41D 13/1272
See application file for complete search history.

(56) References Cited

U.S. PATENT DOCUMENTS 302,901 A * 8/1884 Fenne ..... A41D 13/1236 2/114
818,351 A 4/1906 Clark
1,489,046 A * 4/1924 Thompson ..... A41B 9/08 2/269

(Continued)

OTHER PUBLICATIONS

"Hudson Baby Premium Shoulder Snap Bodysuit Girls' Extended Family, Loved by Grandma—Newborn", web. Retrieved. Apr. 20, 2020, www.Amazon.sg_Fashion. Aug. 3, 2009. (Year: 2009).*

(Continued)

*Primary Examiner* — Jillian K Pierorazio

(57) ABSTRACT

One or more embodiments of the disclosure include a medical garment for exposing a person's upper torso and a method of making the garment. The garment can resemble a shirt, in that sleeves may extend to about the elbows or wrists, the garment may extend down to the waist, and other than one or more flaps configured to open to expose an upper torso the medical garment is substantially free of openings. The garment may include a body with a front portion attached to a back portion by non-partable seams. The sleeves can be coupled to the front and back portions. The flap(s) may include a partable seam that extends from a top portion of the body toward but not substantially beyond a bottom part of the sleeves where they attach to the body. The flap(s) may also include a fastener to hold the partable seam in a closed position.

12 Claims, 3 Drawing Sheets

(56) References Cited

U.S. PATENT DOCUMENTS 1,998,051 A * 4/1935 Gerber ..... A41D 13/1236 2/114
2,341,797 A 2/1944 Murray
2,428,198 A * 9/1947 Brohard, Jr. ..... A41D 1/02 2/96
2,523,175 A * 9/1950 Yates ..... A41B 1/10 2/128
2,582,811 A * 1/1952 Williams ..... A41D 13/012 2/82
2,722,686 A 11/1955 Hoskings
3,276,036 A * 10/1966 Cater ..... A41D 13/1245 2/114
3,611,439 A * 10/1971 Meyers ..... A41D 1/215 2/104
4,004,294 A * 1/1977 Pinch ..... A41D 1/215 2/104
4,031,566 A * 6/1977 Johnson ..... A41D 1/215 2/104
4,144,593 A * 3/1979 Timmons ..... A41D 1/215 2/104
4,208,743 A * 6/1980 Whitcraft ..... A41D 1/215 2/104
4,434,511 A * 3/1984 Weiser ..... A41D 13/1236 2/114
4,446,572 A * 5/1984 Lindquist ..... A41D 1/215 2/104
4,547,907 A * 10/1985 Netsky ..... A41D 13/129 2/114
4,570,268 A 2/1986 Freeman
4,578,062 A 3/1986 Schneider
4,718,124 A * 1/1988 Sawicki ..... A41D 13/129 2/114
4,764,986 A * 8/1988 Stewart ..... A41D 13/129 2/135
4,920,578 A * 5/1990 Janzen ..... A41D 13/129 2/114
5,048,122 A * 9/1991 Prieur ..... A41D 13/1272 2/80
5,062,159 A 11/1991 Jakub
5,133,086 A * 7/1992 Truitt ..... A41D 13/1236 2/105
5,392,466 A 2/1995 Chou et al.
5,440,763 A * 8/1995 Shah ..... A41D 13/129 2/912
5,611,087 A * 3/1997 Adkins ..... A41D 13/129 2/919
5,727,256 A * 3/1998 Rudman ..... A41D 31/14 2/DIG. 1
5,799,330 A * 9/1998 O'Donoghue-Kitt ..... A41D 13/1236 2/908
5,829,059 A * 11/1998 Covington, Jr. ... A41D 13/1263 2/69
D414,015 S * 9/1999 Small ..... D2/847
6,032,287 A * 3/2000 Kallas ..... A41D 15/00 2/74
6,216,271 B1 4/2001 Chen
6,450,168 B1 * 9/2002 Nguyen ..... A61B 5/6805 128/877
6,647,552 B1 * 11/2003 Hogan ..... A41D 13/1245 2/114
6,973,673 B2 12/2005 Beuk
7,010,812 B1 * 3/2006 Cho ..... A41D 13/1245 2/104
7,073,204 B1 * 7/2006 Boyles ..... A41D 13/1236 2/114
7,181,773 B1 * 2/2007 Piraka ..... A41D 13/1281 2/114
7,350,239 B1 * 4/2008 Rosenzweig ..... A41B 13/10 2/49.1
7,454,798 B2 11/2008 Feodoroff
D584,483 S 1/2009 Glynn
7,810,171 B2 * 10/2010 Moore ..... A41D 1/215 2/104
7,810,172 B2 * 10/2010 Williams ..... A41D 13/1236 2/114
7,987,524 B2 * 8/2011 Bower ..... A41D 13/1245 2/114
2001/0039672 A1 * 11/2001 Force ..... A41D 1/215 2/104
2003/0126668 A1 * 7/2003 Scroggins ..... A41D 13/1236 2/114
2004/0166766 A1 * 8/2004 Schneider ..... A41D 1/215 450/36
2005/0010988 A1 * 1/2005 Ragot ..... A41D 13/012 2/2.15
2005/0028241 A1 * 2/2005 Ragot ..... B63C 11/04 2/69
2006/0031976 A1 * 2/2006 Nwawka ..... A41D 13/1245 2/114
2006/0143778 A1 * 7/2006 Shak ..... A41D 7/008 2/114
2007/0245450 A1 * 10/2007 Feodoroff ..... A41D 13/1254 2/114
2008/0115255 A1 * 5/2008 Gorman ..... A41D 13/1263 2/114
2009/0000008 A1 * 1/2009 Moore ..... A41D 1/215 2/104
2009/0100569 A1 * 4/2009 Butler ..... A41F 1/00 2/114
2010/0251456 A1 10/2010 Bower
2010/0299803 A1 * 12/2010 Ladra ..... A41D 13/1245 2/114
2012/0005803 A1 * 1/2012 Sagami ..... A41D 13/1245 2/114
2012/0078190 A1 * 3/2012 Austin ..... A61M 25/02 2/300
2012/0137400 A1 * 6/2012 Farris ..... A41D 13/1245 2/114
2013/0067633 A1 * 3/2013 Salem ..... A41D 13/1245 2/102
2014/0157479 A1 * 6/2014 Streep ..... A41D 13/1245 2/69
2015/0374048 A1 * 12/2015 Theodossiou ..... A41D 13/1245 2/114

OTHER PUBLICATIONS

Baby Gap; bodysuit with snap shoulders; http://gap.com/browse/product.do?

* cited by examiner

MEDICAL GARMENT FOR CHEST DEVICES AND PROCEDURES

CROSS-REFERENCE TO RELATED APPLICATIONS

This application is a continuation of and claims priority to U.S. patent application Ser. No. 15/885,605, filed Jan. 31, 2018, which claims priority to U.S. patent application Ser. No. 13/363,104, filed Jan. 31, 2012, the contents of which are incorporated herein by reference in their entirety.

BACKGROUND

Discussion of the Related Art

For patients receiving certain medical treatments, it is often necessary to remove clothing to expose body areas for receiving treatment, connect medical devices, or allow access to such medical devices. Many people have aversions to disrobing and wearing hospital medical gowns, often with the feeling that their bodies are prone to unnecessary exposure due to the way the garments are constructed. Others feel that changing into a medical gown is inconvenient and unnecessary when receiving a quick medical procedure. This can be particularly troublesome with young children, as they often will resist multiple changes of clothes or any clothing that is deemed uncomfortable.

For instance, U.S. Pat. No. 7,454,798 to Feodoroff relates to a medical garment configured to be worn by a patient requiring medical attention. The application discloses a blouse portion, a shoulder portion, a torso portion, two arm portions, an open front, and at least one fastener; a breast access panel separate from the open front and extending from the shoulder portion to the waist of the patient, a strip of hook and loop material attached to an inside of the breast access panel; a mating strip of hook and loop material attached to an outside of the torso portion, wherein the breast access panel is configured to be moved between ins open and closed positions while maintaining the open front in its closed position. The configuration of the breast access panel provides much too large of an access area to the wearer's chest.

U.S. Pat. No. 6,647,552 to Hogan discloses a medical dignity garment allowing access to a medical access area of the patient without removal of the garment and closure over the garment while treatment is in progress, comprising a body portion, and front panels having at least one flap, the flap defined by placket, lower, sleeve, and folding edges. The flap can be folded along the folding edge. Due to the configuration of openable edges, the way that the flap opens is not ideal for procedures on the chest area from above in comparison to the present disclosure.

SUMMARY

Thus comes the need for a medical garment that allows a patient to wear the garment in or out of the hospital, while still providing access to the areas needed to receive medical treatment when necessary.

The present embodiments seek to solve problems present in the prior art, including, for example, that many medical garments are not suited to casual wear, and medical garments with access means to the wearer's body often expose a larger area than required, or provide access in such a way that is incompatible with comfortable routing of medical devices or components being used in certain treatments.

Such a garment optionally should not resemble a medical garment so that it may be worn casually, and be comfortable to wear when sitting, standing, or laying down. In addition, one or more embodiments provide access to a wearer's chest without having to remove the medical garment.

In one aspect of the present disclosure, one or more embodiments of the present disclosure are directed to a medical garment outwardly resembling a shirt, in that when the garment is worn by a person one or more sleeves are configured to extend to about the person's elbow or wrist and at least partially surround the person's arm and a bottom portion of a body of the medical garment is configured to extend to about the person's waist. The medical garment can include one or more flaps configured to open to expose an area of the person's upper torso. Other than the one or more flaps, the medical garment may be substantially free of openings that would expose the upper torso. In one or more embodiments the medical garment includes a body with a front portion attached to a back portion by one or more non-partable seams. First and second sleeves can be coupled to the front portion and the back portion. The flap can include a partable seam that extends from a top portion of the body toward but not substantially beyond a bottom part of the first or second sleeve where the first or second sleeve attaches to the body. The partable seam may extend from the top portion of the body along a shoulder region of the body and extends from the shoulder region down toward but not substantially beyond the bottom part of the first or second sleeve where the first or second sleeve attaches to the body. When the partable seam is in an open position, at least one of the flaps may be formed in the front portion of the body. The front portion and the back portion of the garment may define an opening at the top of the body, and the first partable seam can extend from the opening, such that when the partable seam is in an open position a perimeter of the opening is broken. The one or more flaps may be configured to fold outwards and downwards to expose the upper torso of the person. The medical garment can further include a fastener to hold the partable seam in a closed position. The fastener may be any one of or a combination of a hook-and-loop type fastener, a button, a clip, a zipper, and a clasp.

In another aspect of the present disclosure, one or more embodiments include a medical garment with a body that includes a front portion attached to a back portion by one or more non-partable seams. The garment may further include a sleeve coupled to the front portion and the back portion. In addition, the garment may include a collar at a top portion of the body. The collar may define an opening having a perimeter. The garment may further include a partable seam that extends: (i) from the opening along a shoulder region at or near the top of the body, (ii) from the shoulder region down along the entirety of a sleeve adjacent region of the front portion, and (iii) from the sleeve adjacent region toward the bottom portion of the body. Moreover, the garment may include a fastener configured to hold the partable seam in a closed position and to release the partable seam into an open position such that the partable seam at least partially defines a flap. The flap can overlap a portion of the body and the area of where the flap overlaps the body can be reinforced. The fastener may be any one of or a combination of a hook-and-loop type fastener, a clip, a button, a zipper, and a clasp.

In one or more embodiments, no other partable seam defines the flap. When the partable seam is in the open position the perimeter of the opening may be broken. When the garment is worn by a person the sleeve can be configured to extend to about the person's elbow or wrist and at least partially surround the person's arm and the bottom portion of the body can be configured to extend to about the person's waist. When the partable seam is in the open position the flap is configured to expose a portion of the person's torso. Other than the flap the medical garment may have no more than one other flap for exposing an upper torso or arm of the person.

In yet another aspect of the present disclosure, one or more embodiments of the disclosure include a method of making a medical garment that resembles a shirt, in that when the medical garment is worn by a person, first and second sleeves of the medical garment may be configured to extend to about the person's elbows or wrists, the medical garment may be configured to extend down to about the person's waist, and other than one or more flaps configured to open to expose an area of the person's upper torso the medical garment may be substantially free of openings that would expose the upper torso.

The method may include providing a body comprising a front portion and a back portion. The method may further include attaching the front portion to the back portion by at least one non-partable seam. The method may further include attaching first and second sleeves to the body. The method can further include attaching the front portion to the back portion by at least one partable seam that extends from a top portion of the body down toward but not substantially beyond a bottom part of the first or second sleeve where the first or second sleeve attaches to the body. The partable seam may extend from the top portion of the body along a shoulder region of the body and may extend from the shoulder region down toward but not substantially beyond the bottom part of the first or second sleeve where the first or second sleeve attaches to the body. The combination of attaching the front portion to the back portion by at least one non-partable seam and attaching the front portion to the back portion by at least one partable seam may form a collar at the top of the body. The collar may define an opening at the top of the body. The partable seam can extend from the opening. When the partable seam is in an open position a perimeter of the opening may be broken. The method can further include attaching a fastener to the body. The fastener can be configured to releasably hold the partable seam in a closed position. The fastener may be any one of or a combination of a hook-and-loop type fastener, a button, a clip, a zipper, and a clasp.

BRIEF DESCRIPTION OF THE DRAWINGS

The above and other aspects, features and advantages of the present disclosure will be more apparent from the following more particular description thereof, presented in conjunction with the following drawings, wherein.

Figure 1:
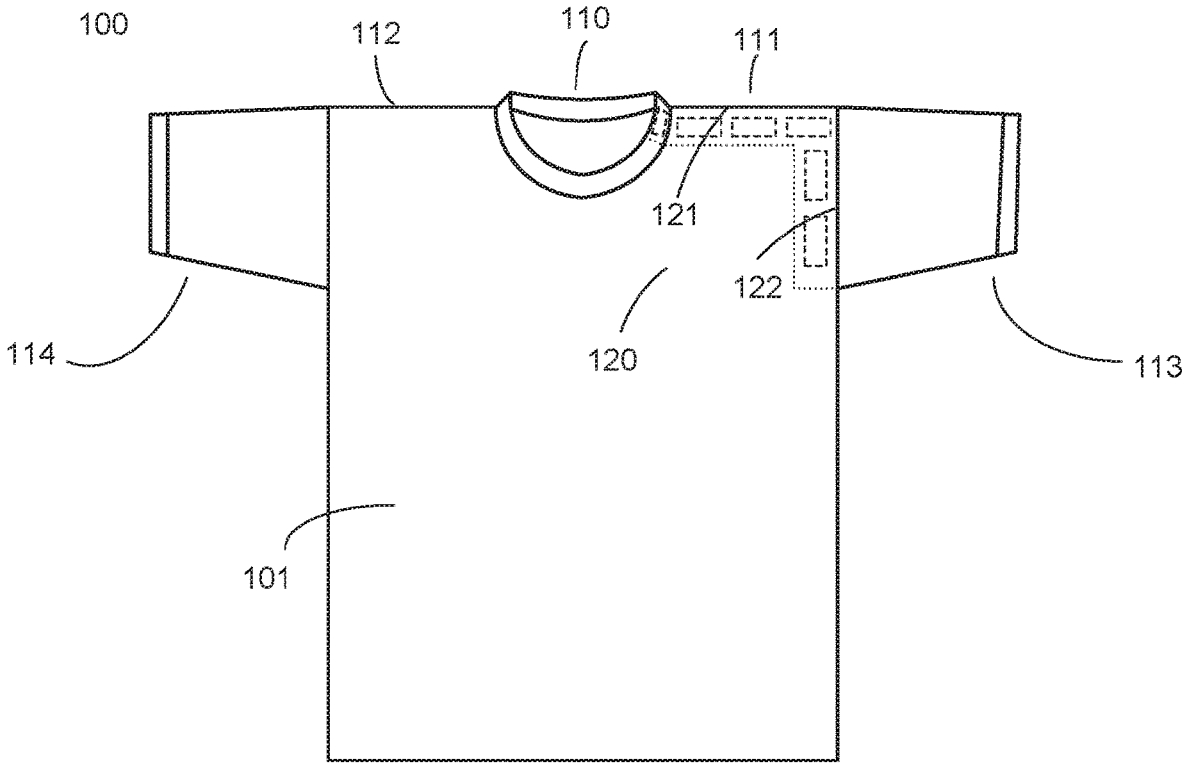
FIG. 1 shows a front view of a medical garment with the outward appearance resembling a standard t-shirt in accordance with one embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions, sizing, and/or relative placement of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure. It will also be understood that the terms and expressions used herein have the ordinary meaning as is usually accorded to such terms and expressions by those skilled in the corresponding respective areas of inquiry and study except where other specific meanings have otherwise been set forth herein.

DETAILED DESCRIPTION

The following description is not to be taken in a limiting sense, but is made merely for the purpose of describing the general principles of the disclosure. The scope of the disclosure should be determined with reference to the claims. The present embodiments address the problems described in the background while also addressing other additional problems as will be seen from the following detailed description.

The present disclosure relates generally to medical garments. More specifically, the present disclosure relates to a medical garment designed to outwardly resemble a standard t-shirt, while providing easy access to medical devices attached to the wearer's chest.

Referring to FIG. 1, shown is a front view of a medical garment 100 with the outward appearance resembling a standard t-shirt in accordance with one embodiment. A body including a front portion 101 is shown, with a collar 110 configured to surround the wearer's neck at the top of the front portion 101. Adjacent to the collar 110 on each side are a first shoulder region 111 and a second shoulder region 112. On the sides of the front portion 101, a first sleeve 113 and a second sleeve 114 are attached, which are configured to surround the wearer's arms. A flap 120 in the closed position is located at the first shoulder region 111 and adjacent to the first sleeve 113. The flap 120 is positioned such that a portion of the chest area of the wearer is exposed when the flap 120 is in the open position. A first partable seam 121 is formed on the front portion 101, extending from the collar 110 and along the first shoulder region 111 to the top of the first sleeve 113. A second partable seam 122 is also formed on the front portion 101 and located at the proximal end of the first sleeve 113 and extends from the top to the bottom of the first sleeve 113. In this configuration, the flap 120 opens at the first partable seam 121 and the second partable 122 to expose the left side of the wearer's chest to provide access for medical personnel. Alternatively, the flap 120 may be positioned for access to the right side of the wearer's chest by locating the first partable seam at the second shoulder region 112 and the second partable seam at the second sleeve 114.

The configuration of the flap 120 and first and second partable seams 121 and 122 provide the benefit of easy access to medical devices used on the wearer's chest area while allowing the wearer to keep wearing the garment. Particularly, the orientation of flap 120 provides benefits in the use of central venous catheters ("CVC") such as tunneled catheters or implanted ports (port-a-caths), which are used in chemotherapy treatments or other procedures. These types of CVC devices are implanted into patients and designed to provide ready access to administer medication or fluids, draw blood, or directly obtain cardiovascular measurements, thus eliminating the need for constant needle pricks. CVCs generally comprise an access port and line that enters at a point near or on the wearer's chest and tunnels under the skin, with the exit portion inserted into a blood vessel near the wearer's heart, typically the subclavian vein or the superior vena cava. These types of devices are designed to remain in place for long periods of time, on the order of months to years, and require some type of routine maintenance during its use to prevent infection and thrombosis. The flap 120 can be opened to allow access to catheter lines and other attachments for such medical procedures or maintenance. Further, the orientation of the flap 120 and the first partable seam 121 and second partable seam 122 allow for access to the wearer's chest while the wearer is sitting down (i.e., access from above) or while laying down.

Figure 2:
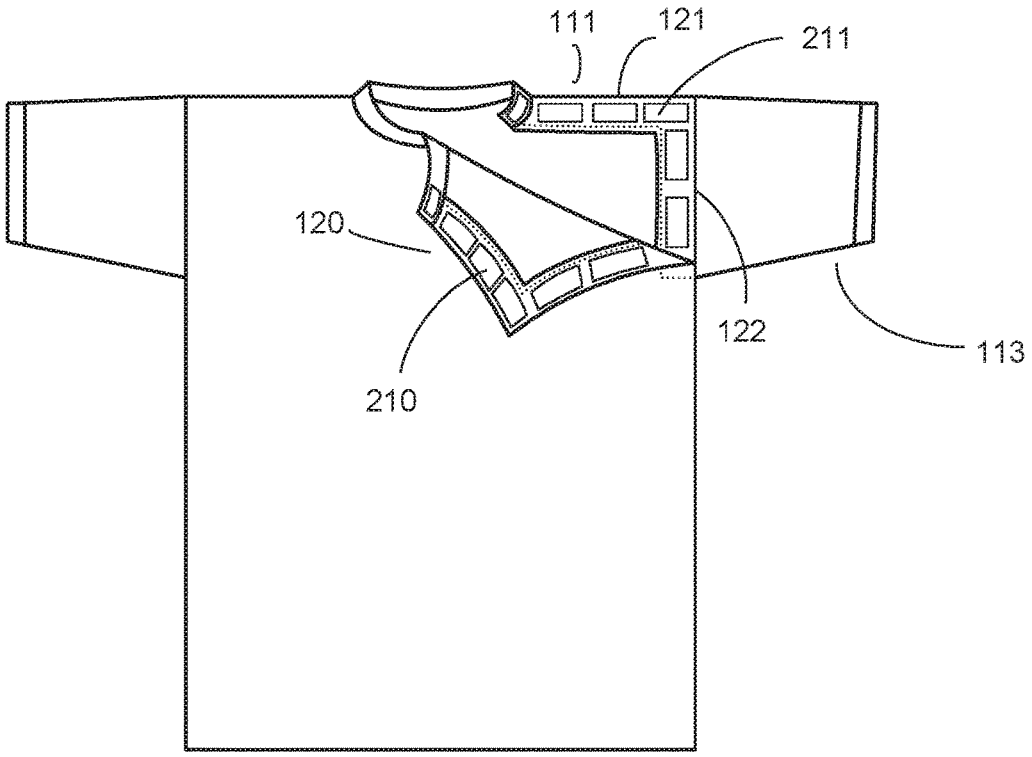
FIG. 2 shows a front view of the medical garment of FIG. 1, with a flap in the open position.

Referring to FIG. 2, shown is a front view of the medical garment 100 of FIG. 1, with the flap 120 in the open position, partially revealing an inside surface of a back portion 301. The flap 120 is opened at the first partable seam 121 and second partable seam 122, with a plurality of fasteners 210 attached to the inside surface of the flap 120 and a plurality of opposing fasteners 211 attached to the back portion 301 at the first partable seam 121 and the first sleeve 113 at the second partable seam 122. As can be seen, the flap 120 opens to expose a portion of the wearer's chest while keeping the rest of the wearer's torso covered. The configuration of the first partable seam 121 and second partable seam 122 along the first shoulder region 111 and the first sleeve 113, respectively, allow for medical procedures to be conducted on the exposed portion of the wearer's chest from above if the wearer is in the sitting position. Such a configuration also allows medical tubing, wiring, or other medical devices and components to be routed out of the garment to external machines or devices in a comfortable manner.

Figure 3:
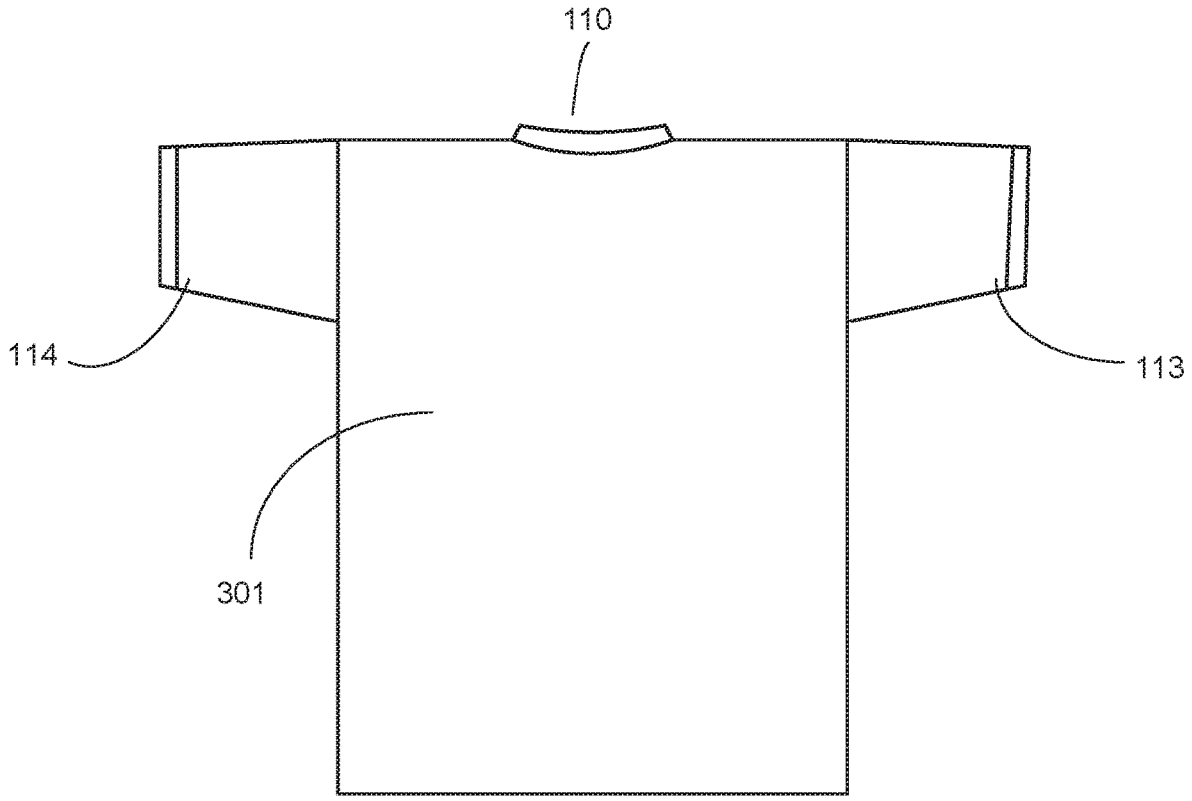
FIG. 3 is a back view of the medical garment of FIG. 1, showing the back portion, the collar, and the back of the sleeves.

Referring to FIG. 3, shown is a back view of the medical garment 100 of FIG. 1, showing the body including an outside surface of the back portion 301, the back view of the collar 110, and the back of the first sleeve 113 and second sleeve 114. Viewed from the back, the medical garment 100 resembles a standard t-shirt whether the flap 120 is in the opened or closed position.

Figure 4:
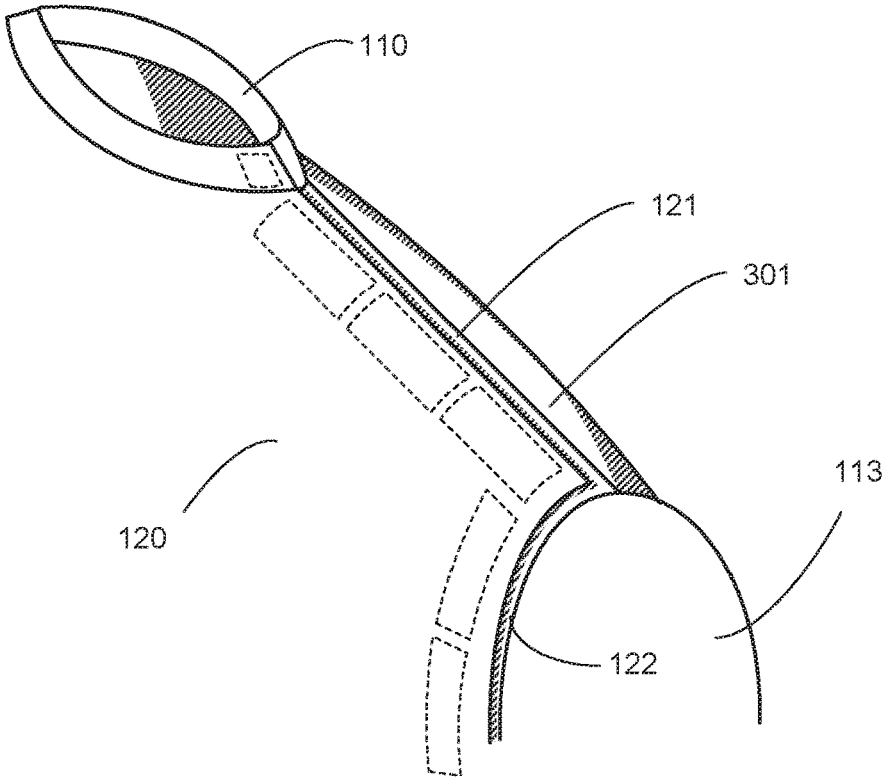
FIG. 4 is perspective view of the medical garment of FIG. 1, showing the flap in the closed position and further showing the first and second partable seams.

Referring to FIG. 4, shown is a perspective view of the medical garment 100 of FIG. 1, showing the flap 120 in the closed position and further showing the first partable seam 121 and second partable seam 122. The first partable seam 121 runs from the collar 110 and along the first shoulder region 111, ending at the top of the first sleeve 113. The second partable seam 122 runs from the top of the first sleeve 113 to the bottom of the first sleeve 113. Fasteners hold the flap 120 closed against the back portion 301 at the first partable seam 121, and at the second partable seam 122. With the flap 120 in the closed position, the first partable seam 121 is aligned with the back portion 301 and the second partable seam 122 is aligned with the first sleeve 113 in such a way that the medical garment 100 outwardly resembles a standard t-shirt, concealing the appearance of the first and second partable seams 121 and 122.

Figure 5:
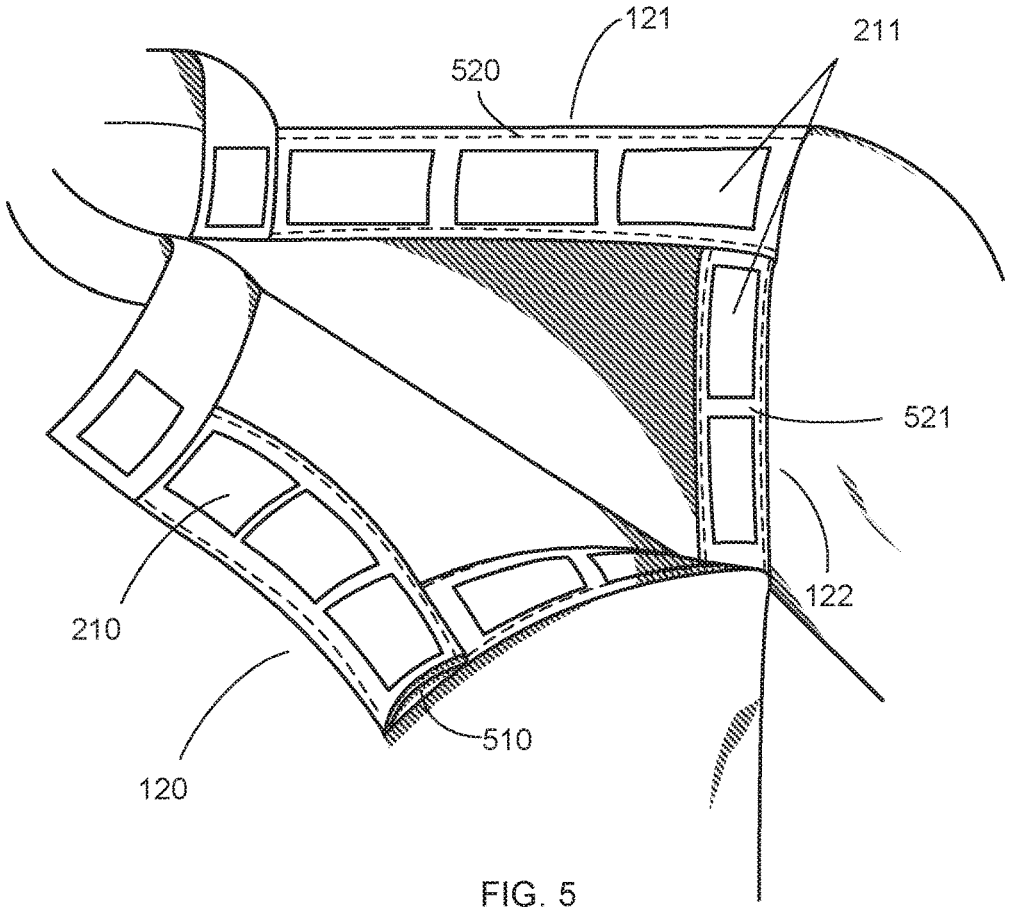
FIG. 5 is a closer view of the open flap of FIG. 2 as seen from the front, showing a first overlap area at the shoulder region and a second overlap area at the sleeve.

FIG. 5 is a closer view of the open flap 120 from FIG. 2 as seen from the front, showing a first overlap area 520 at the first shoulder region 121 and a second overlap area 521 at the first sleeve 113. Fasteners 210 and 211 are affixed to the first overlap area 520 and the second overlap area 521. The areas on the flap 120 corresponding to the first overlap area 520 and the second overlap area 521 have a reinforcement 510, shown in FIG. 5 by a folding over of material from the front portion 101 and sewing the material in place. Likewise, the first overlap area 520 at the shoulder region and second overlap area 521 at the sleeve are reinforced by folding over material from the back portion at the first partable seam 121, and a folding over material from the sleeve at the second partable seam 122. Additional or alternative methods of reinforcing first and second overlap areas 520 and 521 and reinforcement 510 on the flap 120 may also be used, such as the addition of cloth or other material, or the embedding of other material.

Some embodiments include the use of different types of fasteners 210 and 211 to hold the flap 120 in a closed position, including hook and loop fasteners, buttons, clips, or zippers. Also, the length of sleeves or number of sleeves present on the garment can be altered in accordance with alternative embodiments.

Catheter lines and other attachments can be comfortably routed from the wearer's chest to outside the garment by passing the lines through the first partable seam 121 or second partable seam 122. The use of the appropriate fasteners at the first and second partable seams 121 and 122 allows the passage of the catheter lines and attachments even while the flap 120 is in the closed position. In some embodiments, avoiding large, hard fasteners at the first and second partable seams allow a person to comfortably wear the medical garment while lying down or sleeping. The medical garment provides efficiency and comfort for the wearer, in both medical and casual capacities.

For example, the use of hook and loop or button type fasteners is suitable for certain medical procedures and situations, particularly when medical tubing or wiring must pass from the wearer's chest to external equipment. The use of the medical garment would allow such tubing or wiring attached to the wearer's chest to pass through the garment while the flap 120 is in a closed position. However, compared to the use of buttons, hook and loop fasteners would provide more comfort to the wearer when the garment is worn laying down, as the hard buttons may impinge on the wearer's neck, shoulders, and arms.

While the disclosure has been described by means of specific embodiments and applications thereof, other modifications, variations, and arrangements of the present disclosure may be made in accordance with the above teachings other than as specifically described to practice aspects of the disclosure within the spirit and scope defined by the following claims.

What is claimed is:

1. A medical garment that resembles a shirt, in that when the medical garment is worn by a person, first and second sleeves of the medical garment are configured to extend to about the person's elbows or wrists, the medical garment is configured to extend down to about the person's waist, and other than one or more flaps configured to open to expose an area of the person's upper torso the medical garment is substantially free of openings that would expose the upper torso, the medical garment comprising:

a body comprising a front portion attached to a back portion by one or more non-partable seams, wherein the first and second sleeves are coupled to the front portion and the back portion;

wherein at least one of the flaps comprises:

a collar that forms a perimeter with a first partable seam that separates at the collar of the medical garment to open, at a breaking point of the collar, and extends from the breaking point of the collar, the first partable seam of the body being located along a top portion of the body and extending toward a top part of the first or second sleeve and a second partable seam extending downward toward but not substantially beyond a bottom part of the first or second sleeve where the first or second sleeve attaches to the body, wherein the at least one of the flaps is configured to open downward from the top portion of the body; and one or more fasteners to hold the first partable seam and the second partible seam in a closed position.

2. The medical garment of claim 1, wherein the first partable seam extends from the top portion of the body along a shoulder region of the body and the second partable seam extends from the shoulder region down toward but not substantially beyond the bottom part of the first or second sleeve where the first or second sleeve attaches to the body.

3. The medical garment of claim 1, wherein when the first partable seam is in an open position, at least one of the flaps is formed in the front portion of the body.

4. The medical garment of claim 1, wherein the one or more fasteners comprises one or more of a hook-and-loop type fastener, a button, a clip, a zipper, and a clasp.

5. The medical garment of claim 1, wherein the front portion and the back portion define an opening at the top of the body, and the first partable seam extends from the opening, such that when the first partable seam is in an open position the perimeter of the opening is broken.

6. A garment, comprising: a body comprising a front portion attached to a back portion; a sleeve coupled to the front portion by at least a portion of a partable seam, and the back portion by at least a portion of a non-partable seam; a collar at a top portion of the body, the collar defining an opening and having a perimeter; wherein a top partable seam extends: from the opening along a shoulder region at or near the top portion of the body, wherein the partable seam extends from the shoulder region down along a sleeve adjacent region of the front portion, toward a bottom portion of the body; and one or more fasteners configured to hold the partable seam and top partable seam in a closed position and configured to release the partable seam and the top partable seam into an open position such that the partable seam and top partable seam at least partially defines a flap, wherein the flap is configured to open from the collar to the shoulder region, where the flap extends from the collar at least along a top portion of the body to the shoulder region, wherein the flap is configured to open away from the top portion of the body and downward toward the bottom portion of the body, wherein no other partable seam defines the flap, wherein the flap is configured such that opening the flap opens the perimeter of the collar at the top portion of the body; wherein when the garment is worn by a person the sleeve is configured to extend to about the person's elbow or wrist and at least partially surround the person's arm and the bottom portion of the body is configured to extend to about the person's waist, wherein when the partable seam and the top partable seam is in the open position the flap is configured to expose a portion of the person's torso, wherein other than the flap the medical garment has no more than one other flap for exposing an upper torso or arm of the person.

7. The medical garment of claim 6, wherein the one or more fasteners comprises one or more of a hook-and-loop type fastener, a clip, a button, a zipper, and a clasp.

8. The medical garment of claim 6, wherein the flap overlaps a portion of the body and an area where the flap overlaps the body is reinforced.

9. A method of making a medical garment that resembles a shirt, in that when the medical garment is worn by a person, first and second sleeves of the medical garment are configured to extend to about the person's elbows or wrists, the medical garment is configured to extend down to about the person's waist, and other than one or more flaps configured to open to expose an area of the person's upper torso the medical garment is substantially free of openings that would expose the upper torso, the method comprising: providing a body comprising a front portion and a back portion; attaching the front portion to the back portion by at least one non-partable seam; attaching the first and second sleeves to the body by a partable seam that extends down toward but not substantially beyond a bottom part of the first or second sleeve where the first and second sleeve attaches to the body; attaching the front portion to the back portion by a top partable seam that extends from a collar along a top portion of the body, wherein opening the collar at the top partable seam from the collar along the top portion of the body opens a perimeter of the collar at the top portion of the body; and attaching a fastener to the body, wherein the fastener is configured to releasably hold at least one of the top partable seam and the partable seam in a closed position.

10. The method of claim 9, wherein a combination of attaching the front portion to the back portion by the at least one non-partable seam and attaching the front portion to the back portion by the top partable seam, forms a collar at the top of the body, the collar defining an opening at the top of the body, wherein the top partable seam extends from the opening, and wherein when the top partable seam is in an open position the perimeter of the opening is broken.

11. The method of claim 9, wherein the fastener comprises one or more of a hook-and-loop type fastener, a button, a clip, a zipper, and a clasp.

12. The method of claim 9, wherein the top partable seam extends from the top portion of the body along a shoulder region of the body and the partable seam extends from the shoulder region down toward but not substantially beyond the bottom part of the first or second sleeve where the first or second sleeve attaches to the body.

* * * * *